US005088270A

United States Patent [19]

Diehl

[11] Patent Number: 5,088,270

[45] Date of Patent: Feb. 18, 1992

[54] FILM-TAIL HEAT SEALING SYSTEM

[75] Inventor: Werner K. Diehl, Coral Springs, Fla.

[73] Assignee: Mima Incorporated, Pompano Beach, Fla.

[21] Appl. No.: 636,485

[22] Filed: Dec. 31, 1990

[51] Int. Cl.[5] ..... B65B 11/02; B65B 13/04

[52] U.S. Cl. ..... 53/399; 53/441; 53/556; 53/588

[58] Field of Search ..... 53/399, 441, 556, 588, 53/589, 218, 329.5, 377.7, 375.9; 493/194, 193

[56] References Cited

U.S. PATENT DOCUMENTS 4,204,377 5/1980 Lancaster et al. ..... 53/587 X
4,271,657 6/1981 Lancaster, III et al. ..... 53/587 X
4,418,510 12/1983 Lancaster, III et al. ..... 53/399
4,619,102 10/1986 Geisinger ..... 53/399
4,829,743 5/1989 Kapke ..... 53/399
4,845,920 7/1989 Lancaster ..... 53/556 X
4,936,080 6/1990 Haloila ..... 53/588 X

*Primary Examiner*—James F. Coan
*Attorney, Agent, or Firm*—T. W. Buckman; D. J. Breh

[57] ABSTRACT

A heat seal assembly and method for securing stretch-film wrapped about a package, which assembly grasps and aligns two strips of roped film wraps, heats adjacent faces of the roped film sections and thereafter compresses these heated faces to weld them to each other and secure the film wrap about the package.

20 Claims, 9 Drawing Sheets

FILM-TAIL HEAT SEALING SYSTEM

BACKGROUND OF THE INVENTION

The present invention relates to a system for wrapping and securing a plastic film wrap about a package. More specifically, the invention relates to an apparatus and method for heat sealing a film wrapper to secure the plastic film about the package, and further, to retain the separated or tail-end in position for subsequent wrapping operations.

There are known techniques available for wrapping packages on pallets with plastic film or plastic netting in various configurations. When the package wrapping is complete, the wrapper is secured to underlying layers of the wrapping film or, alternatively, to the package-bearing pallet. In known apparatus securing is provided by roping the film, that is, constraining the film to a rope-like shape and stapling the roped ends together, as described in U.S. Pat. No. 4,418,510-Lancaster.

U.S. Pat. No. 4,432,185 to Geisinger provided an anvil for determining the position of the package or load to permit other operating mechanisms to be brought into position for clamping, securing by stapling, and cutting the film. These latter elements were mounted on a separate carriage, which moved into a specific relationship with an anvil by sensing the position of the anvil and thus the site of the package to be wrapped. These earlier systems did not utilize heat sealing to secure the film ends.

In U.S. Pat. No. 4,619,102 to Geisinger, a load on a rotating pallet or platform is wrapped by a plastic stretch film. The stretching apparatus and wrapping means are generally positioned on a stationary platform displaced from the vertical plane of the rotating arrangement. The platform further includes a clamp assembly and sealing apparatus for rotating with the load. After initiation of the wrapping cycle, particularly by a first wrap secured about the package, an anvil is brought into contact with the charge and thereafter the wrapping operation commences. A clamp holding the end of the film is released after the film is sufficiently wrapped to retain itself against the charge. After the package is wrapped, a first lap of film is wrapped over the anvil, and thereafter a jaw of the clamp is moved into position adjacent the anvil for a second lap of film to be wound over the anvil and jaw. Subsequently, the heat sealer is activated and cooperates with the anvil to seal the two film laps together, and a second clamp jaw is positioned over the last lap of film to clamp the film together prior to cutting and clamping after completion of the sealing cycle. This clamping apparatus is mounted on the rotating table and requires the package to be in position for location of the anvil against the package or charge for operation of the heating and sealing apparatus. The heat is applied on the external face of the overlapped wraps between the anvil and heat assembly.

The above heating and sealing operations as well as the stapling operations require roping techniques, that is agglomerating or bunching a web of stretch film or film wrap to produce an elongated rope-like element. This roping action is taught in the above-noted apparatus and a further exemplary illustration of such roping is provided in U.S. Pat. No. 4,845,920.

The above-noted wrapping and sealing operations either utilize mechanical apparatus to seal the film to a pallet, or utilize a sealing and clamping apparatus associated with a rotatable table rather than a stationary apparatus remotely displaced and operable to the package. In the earlier application, heat is applied through the outer layer, away from the weldment interface and thus the plastic welding is not as readily controllable.

SUMMARY OF THE INVENTION

The present invention provides a heat sealing assembly for securing overlapped ends of a film wrap to secure the film about the package. More specifically, a heat sealing or weld arrangement provides a seal of overlapping film wraps external of the package at a stationary and independent station displaced from the package, and utilizes the stretch characteristics of such film wrap to recover and retain the weldment at the package surface. The tail end extending from the film roll is cut downstream of the weld and the film strip extending from a film supply roll is retained in a clamp for subsequent wrapping operations. The weldment is provided between overlapped and roped film wraps to be joined by heating the relatively low-temperature melting material with an element at a predetermined temperature for a predetermined time to accommodate the kinetic situation of providing a softened and almost gelatinous surface on both overlapped wraps for joining and weldment between these overlapped wraps. These and other operations will be described below.

BRIEF DESCRIPTION OF THE DRAWINGS

In the Figures of the drawing, like reference numerals identify like components, and in the drawing.

DETAILED DESCRIPTION OF THE PREFERRED EMBODIMENT

Figures 1A, 1B, 2A, 2B, 3A, 3B:
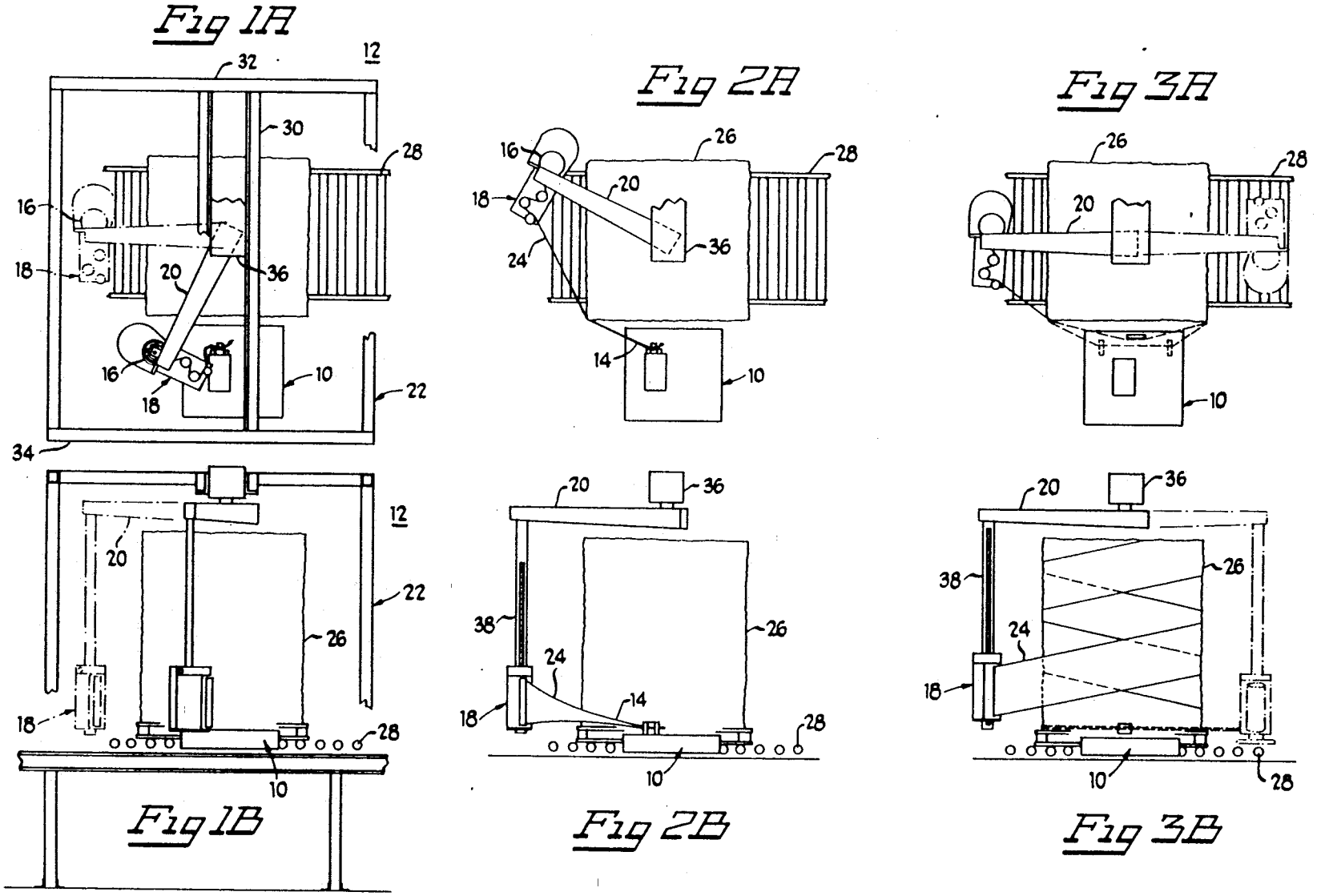
FIG. 1*a* is a plan view of a rotary-boom stretch wrapping assembly.
FIG. 1*b* is an elevational view of the stretch wrapping assembly of FIG. 1*a;*
FIG. 2*a* is a plan view of the boom arm at initiation of a wrapping cycle.
FIG. 2*b* is an elevational view of the initiation of the wrapping cycle and film-tail end retention at a clamp as shown in FIG. 2*a;*
FIG. 3*a* shows the rotary wrapping cycle and illustrates the position of the next-to-last wrap secured at the heat seal assembly.
FIG. 3*b* is an elevational view of the wrapping cycle shown in FIG. 3*a;*
Figure 5A:
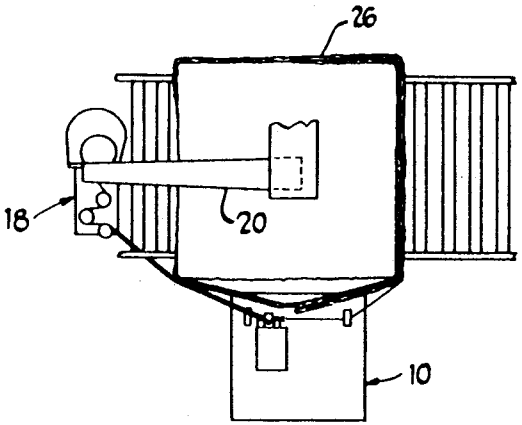
FIG. 5*a* shows a plan view of the as-welded, overlapped rope segments on a wrapped package and the retained film-tail end.
Figure 5B:
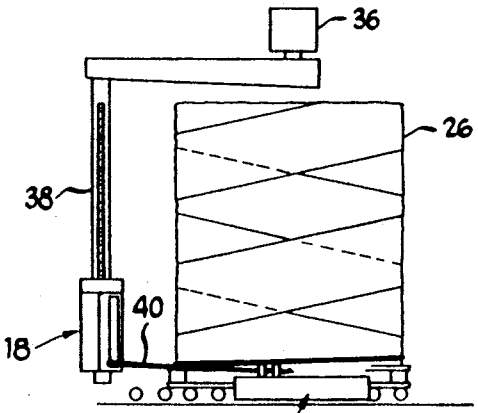
FIG. 5*b* is an elevational view of the illustration in FIG. 5*a;*
Figure 4A:
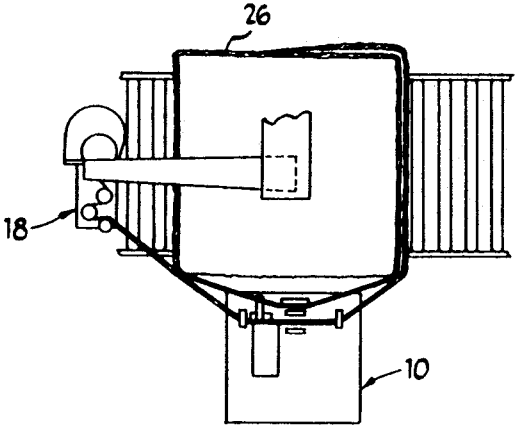
FIG. 4*a* is a plan view of the wrapping apparatus and heat sealing assembly at the heat welding position.
Figure 4B:
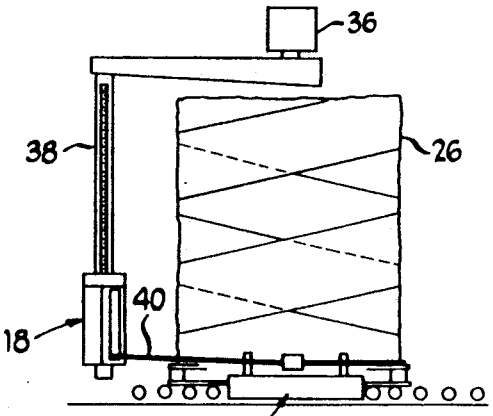
FIG. 4*b* is an elevational view of the illustration in FIG. 4*a;*
Figure 6:
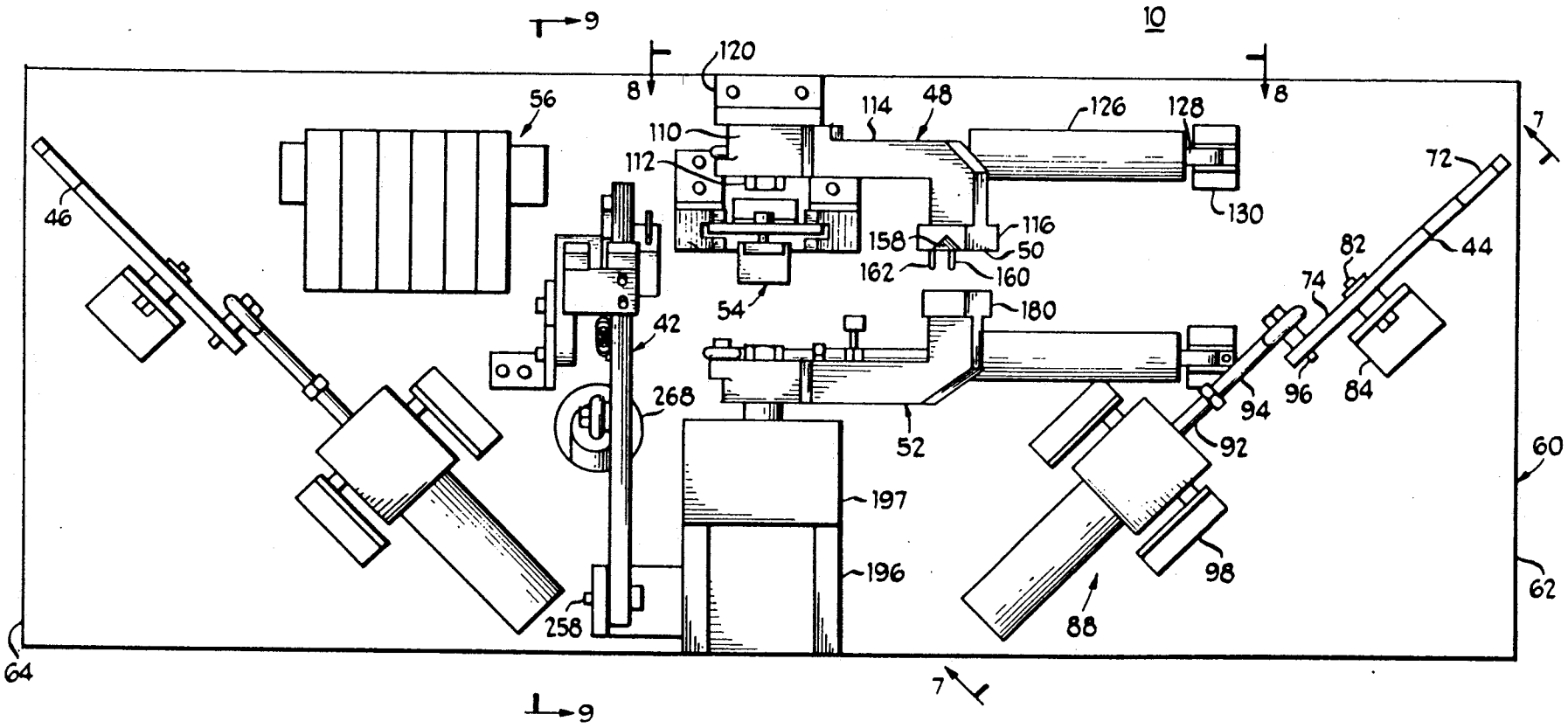
FIG. 6 is a plan view of the heat-seal assembly at a reference position.

A heat-seal assembly 10 for gripping, positioning, and heat sealing the ends of a film-wrapped package is illustrated in plan view in FIG. 6. In a preferred embodiment shown in the Figures, heat-seal assembly 10 is utilized to secure the tail end of a stretch film on a film-wrapped package in stretch-film wrapping apparatus 12, as illustrated in FIGS. 1*a*–5*b* in both plan view and elevational view figures at various wrapping positions. Heat-sealing assembly 10 is operable to retain the trailing or free end 14 of a stretch film wrap extending from a roll of stretch film 16 on film-stretching mechanism 18 affixed to boom arm 20 of assembly 12. Assembly 12 in the Figures is utilized for wrapping a vertical package brought into position within a cage or framework 22 for wrapping with stretch film 24. Framework 22 includes cross-member 30 extending from parallel frame sides 32 and 34 with a generally centered gearbox or bracket 36 centrally positioned above conveyor assembly 28, which gearbox 36 is coupled to boom arm 20. Packages or goods 26 are provided on a conveyor assembly 28 extending between members of rectangular framework 22, which framework 22 is rectangular in both the vertical and horizontal directions to form a generally caged position for the wrapping operations. Package 26 generally proceeds along the conveyor from either the right or left directions as illustrated in the Figures, and is positioned or located within the cage of framework 22 by photoelectric sensors (not shown), which may be mounted on framework 22.

Boom arm 20 in FIGS. 1*a*–5*b* has downwardly extending elevator arm 38 for mounting and reciprocation of film-stretching mechanism 18, which mechanism 18 includes stretch film roll 16 and a roping apparatus. This roping technique has been illustrated in above-cited prior art and essentially bunches or agglomerates stretch film web 24 into an elongate wad of rope to provide a linear film strip at the lower edge, as shown in FIG. 4*b*. In this preferred embodiment, mechanism 18 stretches or elongates film 24 prior to wrapping of package 26 by rotary motion of boom arm 20 and reciprocating travel of stretch film mechanism 18 along elevator arm 38. The mechanism for the reciprocating travel of the mechanical apparatus may include chain-driven assemblies, gear-driven assemblies or other means. As the stretch film and film roll vertically travel along elevator arm 38 during the rotation of boom arm 20, a spiral-wrapping is provided about package 26 as shown in FIGS. 3*b*, 4*b* and 5*b*. This spiral wrapping, stretch film apparatus and technique have been utilized in the art to secure packages and wrap them for shipment, storage or other use. However, at the end of a wrapping cycle the stretch film ends must be secured to the package or pallet to maintain the film in position about the packaged goods 26. As the final or lower end wrap of film 24 proceeds along the package lower edge in proximity to the pallet carrier of package 26, the roping apparatus of mechanism 18 provides an agglomerated or bunched strip of film 24. This roped or final film wrap must be anchored to maintain stretch film 24 about package 26 for retention of package 26 in its wrapped state. As noted above, techniques for securing this final wrap or film-tail 14 have included stapling and heating away from overlapped rope interfaces.

Heat seal assembly 10, which is offset from conveyor 28 and independent of mechanism 18, is a multi-function apparatus to provide a heat seal upon sequential wraps of a film-wrapped package 26, and thus secure film 24 on package 26. The plurality of functions and the associated apparatus to perform the heat sealing operation include the following: gripper-cutter 42 for grasping film-tail 14; first and second rope guides 44, 46 to grasp and align roped film wraps; an anvil 48 for retaining one of the roped film wraps; a heater bar 54 to heat and melt overlapped roped-film wraps; and, a pressure bar 52 for compressing the melted film wrap surfaces against each other and anvil 48 for weldment between the facing surfaces. These several components of heat seal assembly 10 are operable by drive mechanisms, such as pneumatic, hydraulic or electric apparatus including motors and solenoids, to move between reference positions and operating positions.

Assembly 10 includes rope guides 44, 46 to grasp the next-to-final and final film wraps, which are roped, and align this roped film in position with anvil 48 and more specifically, anvil face 50. In FIG. 6, generally rectangular platform or mounting base 60 has first end 62 and second end 64 with pressure bar assembly 52, anvil 48 and heater bar assembly 54 generally centrally located on platform 60, with first and second guides 44, 46 at the opposed first and second ends 62, 64, respectively.

Figure 7:
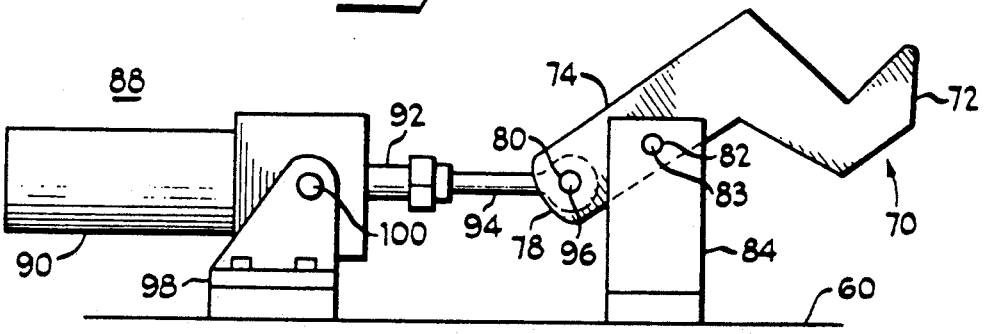
FIG. 7 is an elevational view of a rope-guide arm at the disengaged position taken along line 7—7 in FIG. 6.

Rope guides 44, 46 are similarly structured and operable, therefore, the description of one rope guide will equally apply to the other. First rope guide mechanism 44 in FIGS. 6 and 7 is at its reference position and in FIGS. 10, 11, 13 and 16 is illustrated in the elevated or rope-grasping position. Rope guide 44 has gripping arm 70 with an upper finger 72 and a lower elongate segment 74 intersecting at shoulder 76, which arm 70 at its elevated or operating position is operable to capture the roped film at shoulder 76. Lower end 78 of arm segment 78 has a pivot cross-port 80 for coupling to a drive arm from driving mechanism 88. A second pivot port 82 of lower segment 74 is provided to receive pivot pin 83, which extends through clevis 84 mounted on mounting plate 60, to couple cross-port 80 and finger 72 for pivoting arm 70 about second pivot port 82 by drive mechanism 88.

Figure 19:
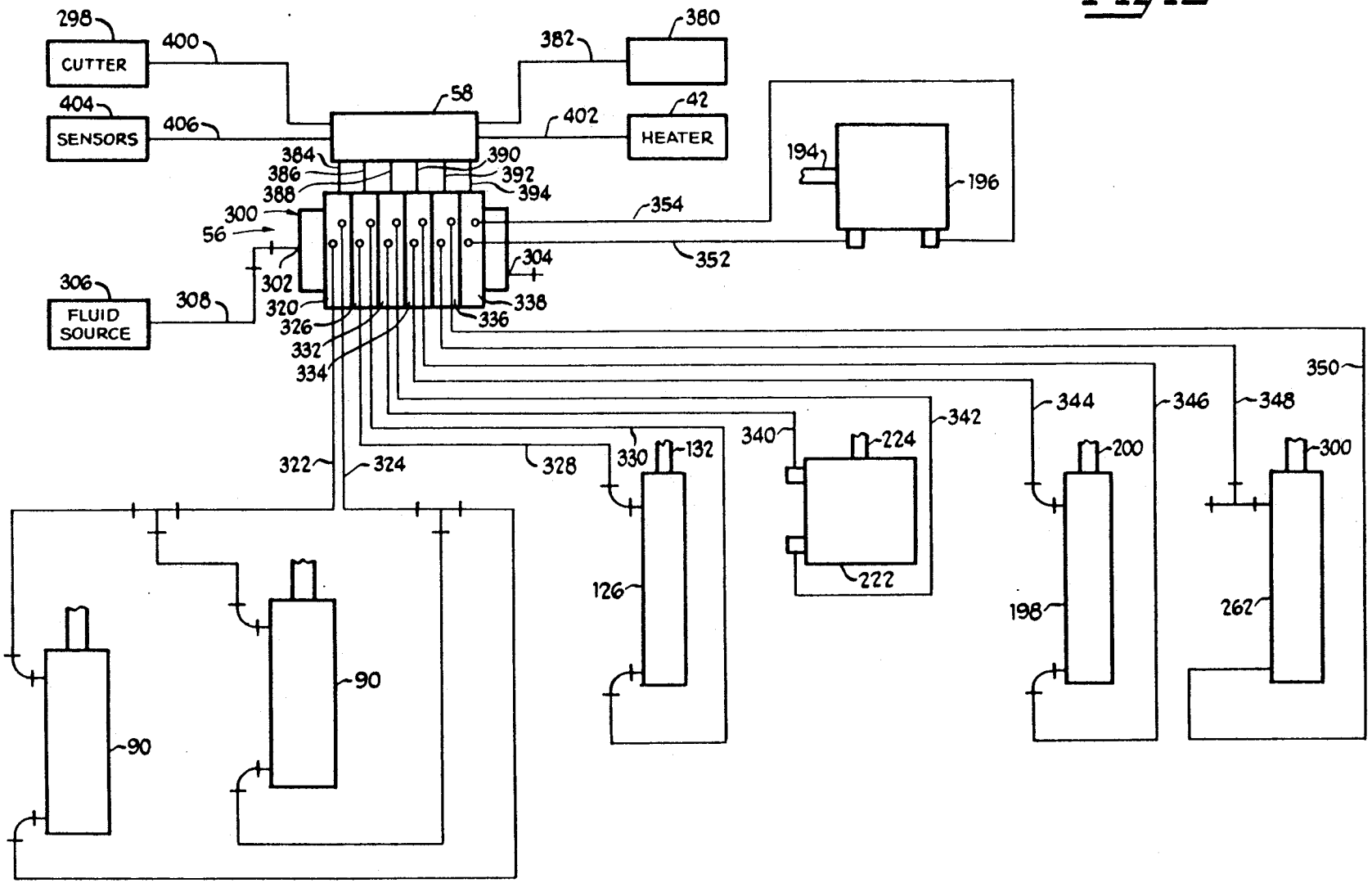
FIG. 19 is a schematic drawing of the fluid flow and electrical circuits of the heat-seal assembly.
Figure 20:
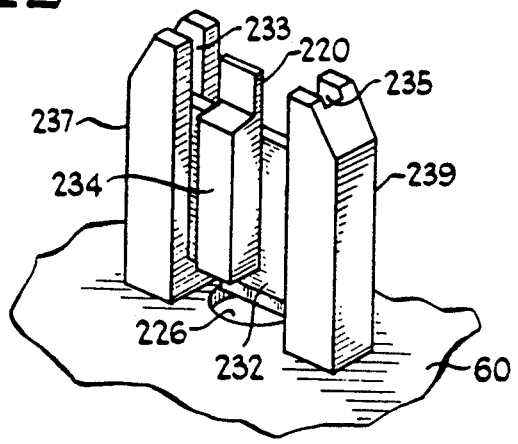
FIG. 20 is a perspective view of the heater bar assembly and slides.
Figure 21:
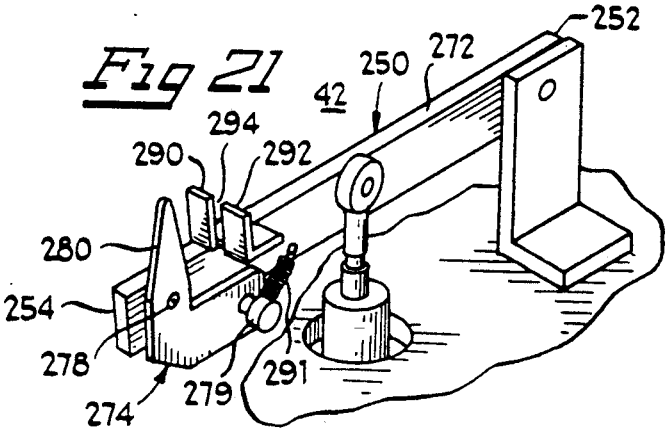
FIG. 21 is a perspective view of the gripper-cutter assembly at the reference position; and, FIG. 22 is an enlarged view of the gripper-cutter assembly arm.
Figure 22:
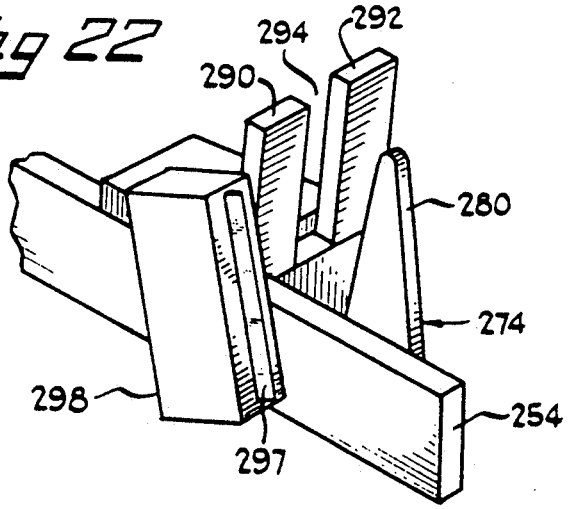

An exemplary driving mechanism 88 for pivoting arm 70 is pneumatically operable cylinder 90 having piston 92 to drive coupling arm 94 pivotally joined to lower segment 74 at first pivot port 80 by pivot pin 96. An exemplary pneumatically operable cylinder is Bimba Model BFT-171.5-D. Operation of pneumatic cylinder 90 moves piston 92 and connecting arm 94 to pivot arm 70 about second pivot pin 82 between its reference or rope-disengaged position and the elevated or rope-engageable position. Clevis 98 is secured on platform 60 to receive pneumatic cylinder 90 for pivotable movement on mounting pin 100 to accommodate variations in the elevation of the coupling arm 94 and piston 92 with changes in the position of arm 70. The pneumatic coupling or connection between cylinder 90 and source of fluid at a pressure 306 through manifold 56 will be disclosed and described below with specific reference to the pneumatic flow diagram in FIG. 19.

In operation, rope guides 44, 46 and their respective fingers 72 are elevated to the rope-engaging position by actuation of pneumatic cylinders 90 to capture the roped film as mechanism 18 traverses past guides 44, 46. The roped segments captured between the guides are tautly held by virtue of the stretching operation and their displacement from package 26. Anvil 48 is simultaneously pivoted with guides 44, 46 from its reference position, which anvil position is generally parallel to mounting platform 60, and brought to an upright or vertical position for rope-engagement. After stretching mechanism 18 has traversed platform 60 and guides 44, 46 to position the next-to-last film wrap in guides 44, 46, these rope guides return to their reference position and the film contacts anvil face 50. Anvil 48 is operable to retain the next-to-last film wrap, which is roped, at a sealing position against its face 50 and to serve as a compression base for pressure bar 52 during the welding operation.

Figure 8:
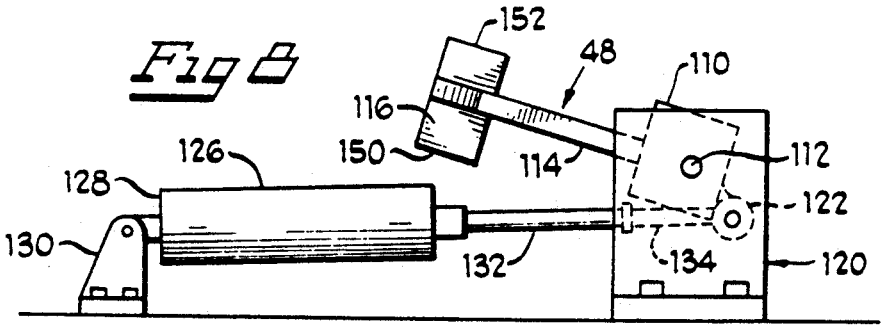
FIG. 8 is an elevational view of a the anvil and cylindrical drive in FIG. 6 taken along line 8—8.
Figure 9:
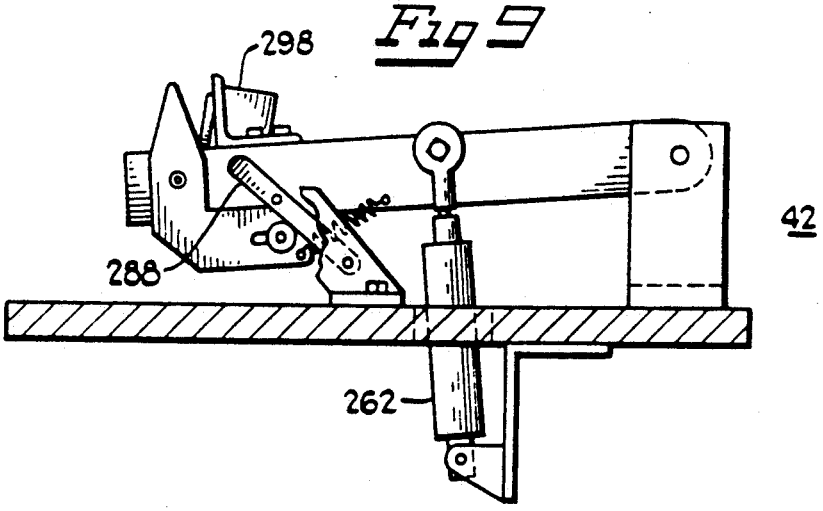
FIG. 9 is an elevational view of the gripper-cutter assembly and piston drive at the disengaged position.
Figure 10:
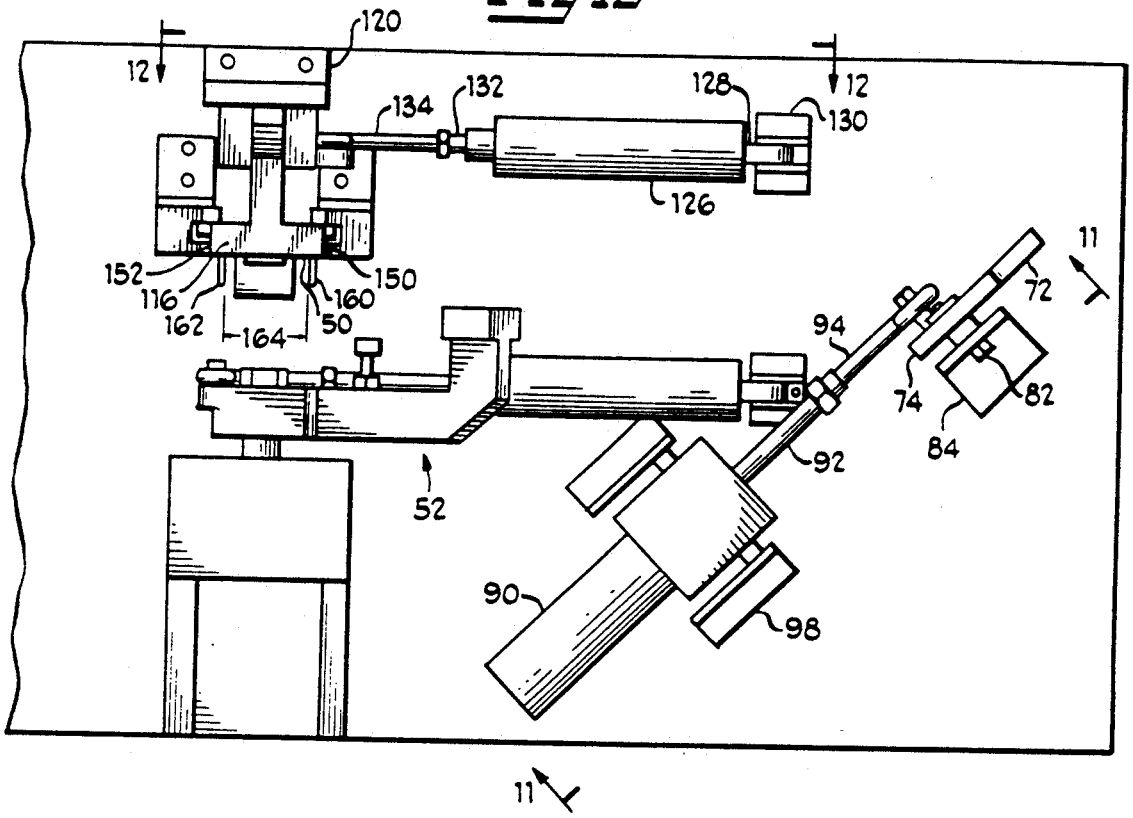
FIG. 10 is a plan view of one segment of the heat-seal assembly with the rope guide and anvil in the engaged position.
Figure 11:
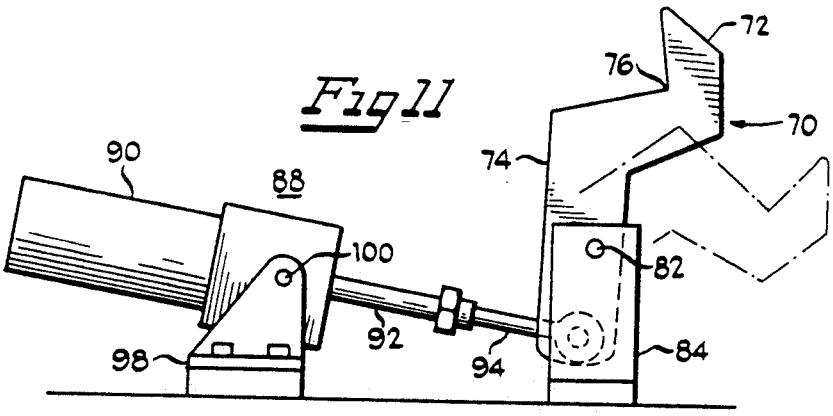
FIG. 11 is an elevational view of a rope guide of FIG. 10 at the film Wrap engaged position taken along line 11—11.
Figure 12:
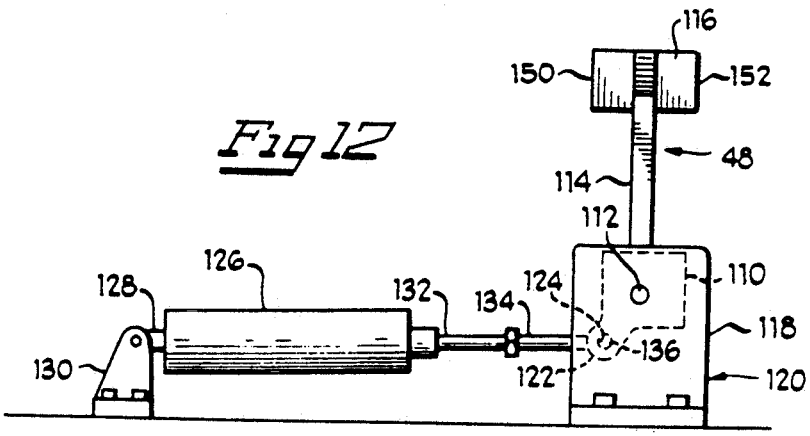
FIG. 12 is an elevational view of the anvil in FIG. 10 taken along line 12—12.
Figure 13:
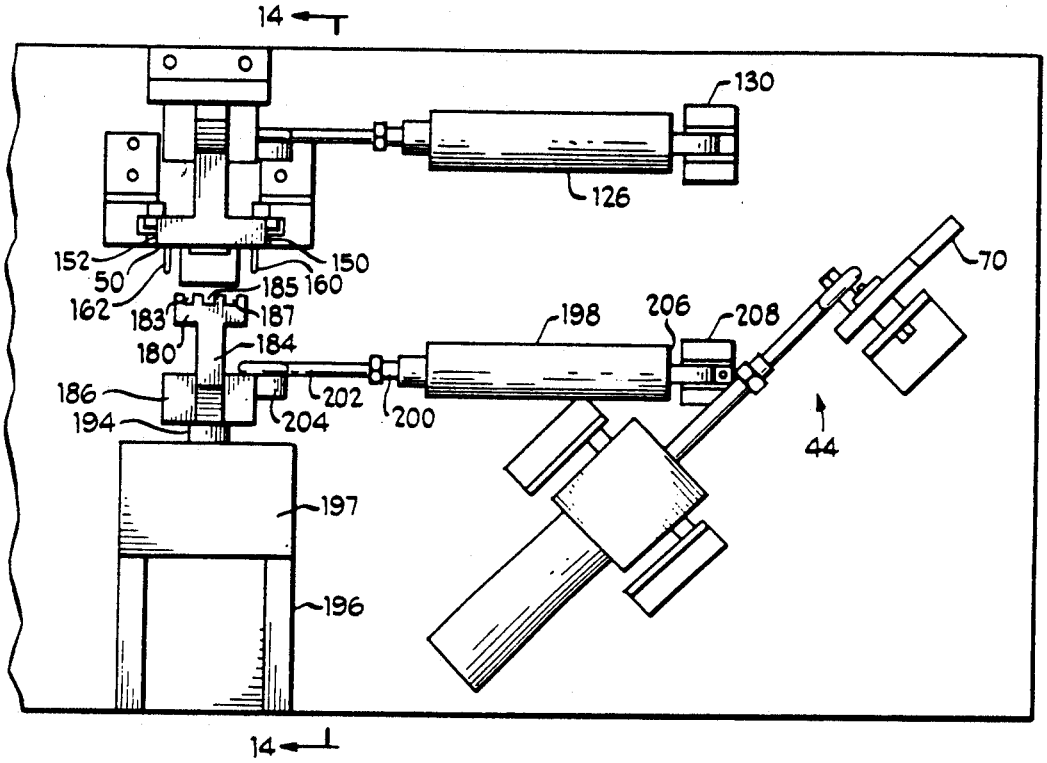
FIG. 13 is a plan view of the heat seal assembly in FIG. 10 with the pressure bar at the operating position.

Anvil 48 is operable between its reference position in FIG. 8 and the elevated or rope-engaging position of FIG. 12. Base member 110 of anvil 48 has a generally centrally located pivot port 112, and an upright arm 114 extending from base 110 terminates at anvil head 116, which includes anvil face 50. Protuberance 122 of base 110 has a pivot port 124 and is pivotally mounted on sidewall 118 of L-bracket 120, which is secured on mounting platform 60. Clevis 130 is secured on mounting platform 60 and has pneumatic cylinder 126 pivotally coupled thereto at cylinder base end 128. In the reference position in FIG. 8, piston or piston rod 132 is at its extended position from pneumatic cylinder 126. Piston 132 of cylinder 126 has pivot arm or spherical rod end 134 coupled to pivot port 124 by pin 136 to rotate base 110 and thus anvil 48 between the reference and upright, rope-engaging positions.

In FIGS. 6, 10, 13, 14, 16 and 17, anvil head 116 has a first sidewall 150 and second sidewall 152, which sidewalls are noted as in a right-to-left direction in the Figures consistent with the illustrations of the mounting platform and the direction of rotation of film 24. The direction of boom rotation in the Figures is for purposes of illustration and is not a limitation, as operation of heat seal assembly 10 can be arranged for boom rotation in either direction. First and second pyramidal notches 156 and 158 in face 50 at first and second sidewalls 150, 152, respectively, are open at these sidewalls and front face to receive the next-to-last wrap of rope after withdrawal of the rope guides from the engaged position. First and second support posts 160, 162 normally extend from front face 50 and provide vertical support for the retained rope wrap secured against anvil front face 50. First and second support posts 160, 162 are separated by gap or working space 164 to receive heating bar 54 and pressure bar 52 and more specifically, the pressure-applying head 180 of pressure bar 52. As noted above, anvil 48 is pivotable between the reference and rope-engaged positions by pneumatic operator 126 in a synchronized relationship with the initial movement of first and second rope guides 44, 46 through the control of control apparatus 58 and manifold 56, which operation will be described below.

Pressure bar 52 for compressing the aligned next-to-last and final roped film wraps against anvil 48 is illustrated in FIGS. 6, 10, 13, 14, 16 and 17, and has an L-shaped profile with longitudinal arm 182 and transverse arm 184 terminating at pressure bar head 180. Lower arm 184 of longitudinal arm 182 terminates at base arrangement 186, which is similar to base arrangement 110 of anvil assembly 48. Base 186 includes a through-bore or mounting port 188 for a mounting and pivot pin 190 matable with longitudinal end 192 of drive shaft 194, which extends from first pneumatic drive operator 196 through clamp block 197 secured to platform 60. Pressure head 180 has contact face 181 in opposed alignment with anvil face 50 at the operating and compression position shown in FIGS. 13, 14, 16 and 17. Vertically extending grooves 183, 185 and 187 in contact face 181 provide multiple contact areas at the weldment. Pressure bar 52 is pivotable on pin 190 and drive shaft 194 by second pneumatic operator 198. In the operable or compressing position, pressure bar 52 is upright on platform 60 and provides pressure head 180 in a face-to-face relationship with anvil head 116 for compression of aligned and facing next-to-last and final rope wraps at the weld position.

Figure 16:
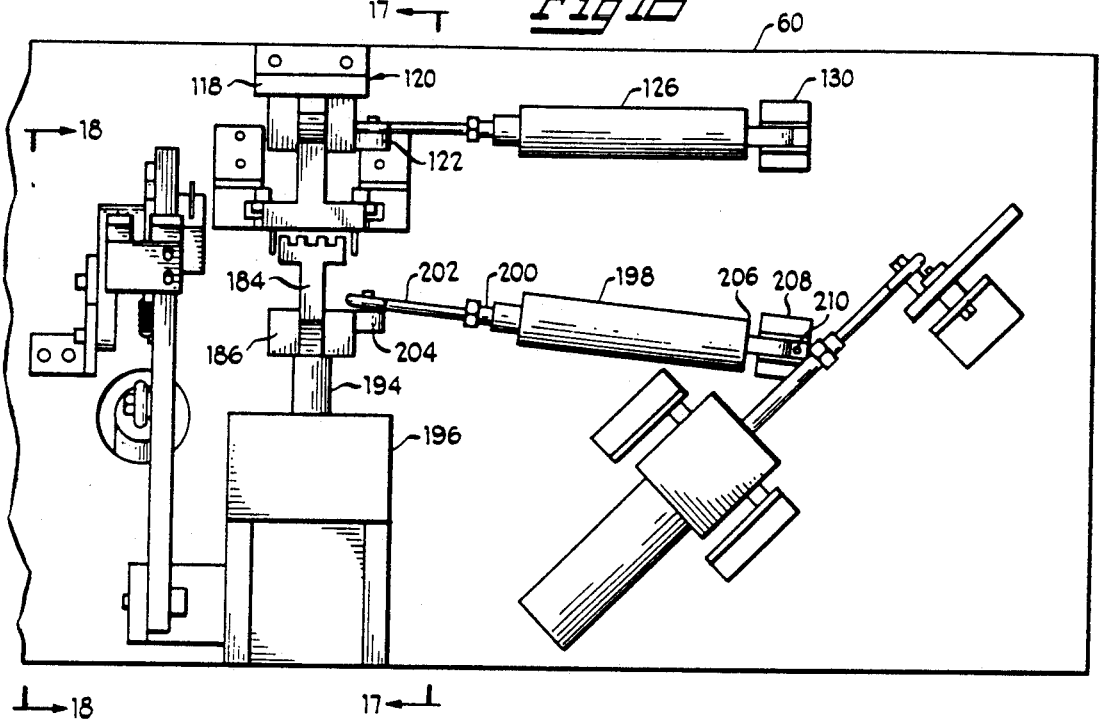
FIG. 16 is a plan view of the heat-seal assembly at the welding position, and further including the gripper-cutter assembly.

Second pneumatic operator 198 includes piston 200 and connecting arm 202, which is coupled to protuberance 204 of pressure-bar base arrangement 186 for pivotably rotating pressure bar arm 182 between the reference position and the operating position. Clevis support system 208 for second pneumatic operator 198 is rotatably mounted on platform 60, and pressure bar assembly 52 is pivotably secured to clevis 208 at second end 206. Pivot and mounting pin 210 secured in mounting platform 60 extends through the base of clevis 208 for clevis rotation about mounting pin 210 as pressure bar 52 moves between the reference position and the extended or compression position, as shown in FIG. 16. Both first pneumatic operator 196 and second pneumatic operator 198 are synchronously operable to provide pressure bar 52 in the operating and upright position after the next-to-last and final rope wraps have been aligned with anvil face 50. Thereafter, heat bar 54 is actuated to move heater element 220 into the gap 164 provided between extending posts 160, 162 and also between the aligned but separated roped film raps.

Figure 14:
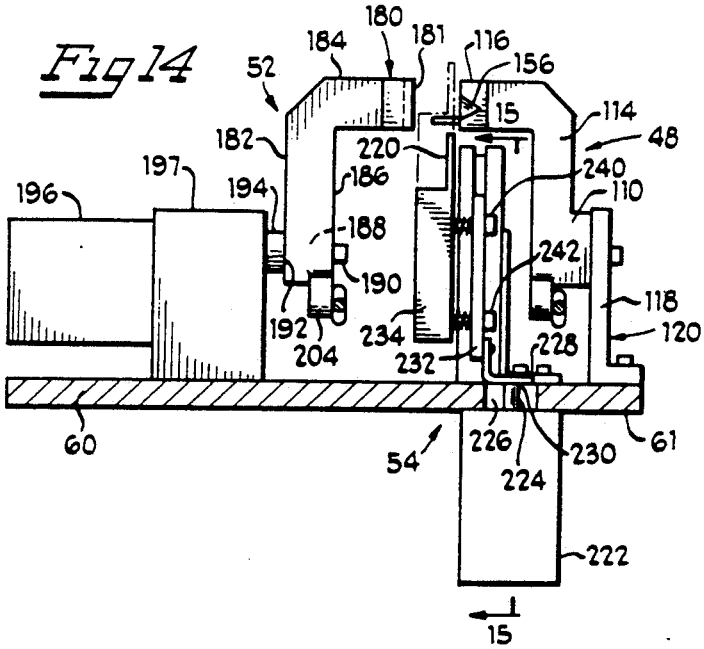
FIG. 14 is a side elevational view of the pressure bar and anvil at the operating position with the heater bar elevated in the gap therebetween and taken along line 14—14 in FIG. 13.
Figure 15:
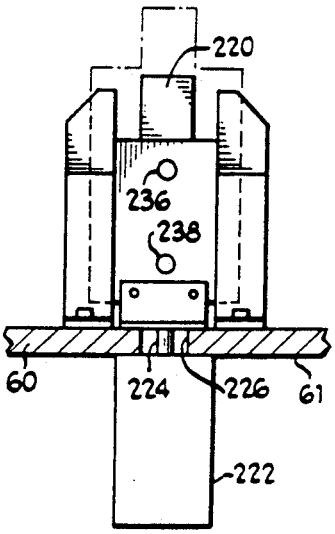
FIG. 15 illustrates the heater bar assembly in a rear elevational view taken along line 15—15 in FIG. 14.

Heater assembly 54 in the several Figures has a continuously heated element 220, which is movable by pneumatic operator 222 mounted on underside 61 of mounting platform 60 to heat the aligned surfaces of next-to-last and final rope wraps between pressure bar 52 and anvil 48 for weldably securing these wraps. Pneumatic operator 222 has a shaft 224 vertically extending through port 226 of plate 60 with a mounting bracket 228 secured to its end 230. Attached to and vertically extending from bracket 228 is securing plate 232, which plate is an insulative material to receive the heating-element body 234. Heating element body 234 is illustrated as a generally rectangular component with second and narrower rectangular protrusion 220 protruding from its upper surface, which protrusion is heater element 220. In the illustration, mounting plate 232 has apertures 236, 238 for securing screws 240, 242 to anchor heater element body 234. Heat bar 54, and more specifically securing plate 232, is slidable in slots 233, 235 of parallel side slideways 237, 239 vertically extending from mounting plate 60. Heat bar assembly 54 is slidable from a first reference and a second vertical position to provide heating element 220 between both pressure bar head 180 and anvil face 116 and the appropriately aligned next-to-last and final rope wraps at the heating and second position. In the heating position, pressure bar 52 is initially moved to press the film rope wraps against heater element 220 to elevate the film surface temperature to a molten or gelatinous state for weldably securing these film surfaces. Temperature control or provision of the weldable surfaces at a temperature for weldable securement is accomplished by maintaining a mass, that is the bulk film rope, in intimate contact with heater element 220 for a predetermined time, which element 220 is continuously maintained at a fixed temperature. Movement of heating element 220 to the heating position is accommodated on a timed or synchronous arrangement through control apparatus 58 and manifold operator 56. Retention of element 200 at the heating position is also controlled by the controlling apparatus 58 to thus limit the time at temperature of the adjacent rope surfaces. The heat bar assembly with element 220 in the heating position between the rope wraps is illustrated in FIGS. 14 and 15, and thereafter is shown in its withdrawn and reference position in FIG. 17 at the compression position of pressure bar 52 and anvil 48.

Gripper-cutter apparatus and assembly 42 at the reference position grasps and retains film-tail 14 as illustrated in FIGS. 6, 9, 18, 22 and 23. Film-tail 14 is retained at the ready position for initiation of a wrapping cycle by stretch film assembly 18 and boom arm 20 until the final film wraps about the lower portion of package 26 during a wrapping cycle, as an example. Thereafter, retained film-tail 14 is released for securement under one of the final package wraps and to subsequently permit the gripper-cutter assembly 42 to grasp the final package wrap, which has been roped, for securement by heat-seal assembly 10. As noted above, the last two-film wraps about package 26 by stretch film mechanism 18 provide a new film-tail 14, which has been roped and wound about the package for grasping by assembly 10 for securement to the film and thus retention of the film wrap about package 26. More specifically, next-to-last wrap of film 24 is provided about package 26 by boom 20 and mechanism 18, which next-to-last wrap is captured by and guided into position on heat-seal assembly 10 by first and second guides 44 and 46 of assembly 10.

Figure 17:
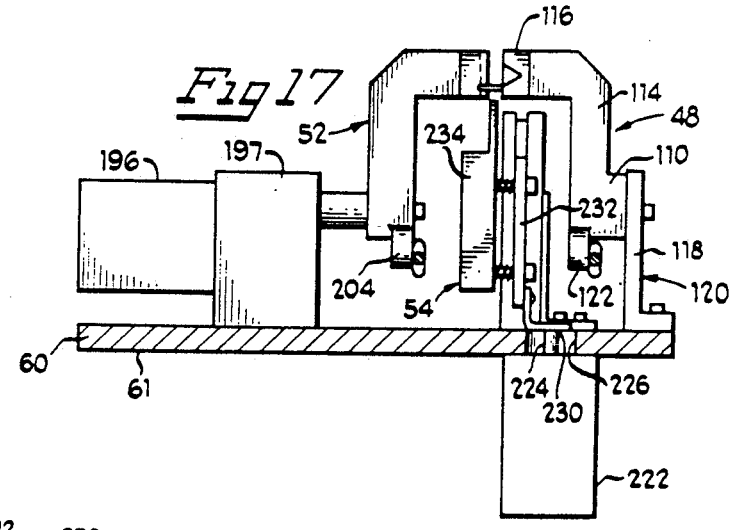
FIG. 17 is an elevational view of the anvil and pressure bar at the welding or compression position in FIG. 16 taken along line 17—17.
Figure 18:
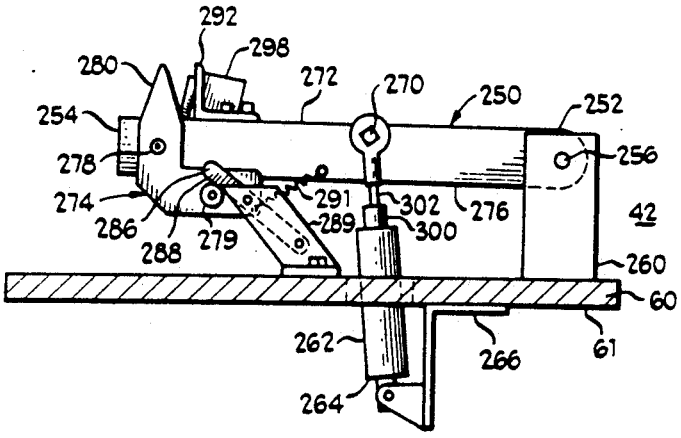
FIG. 18 is an elevational view of the gripper-cutter assembly at the film retention position in FIG. 16 taken along line 18—18.

Prior to or immediately after attaining the pressure or compression stroke illustrated in FIG. 17 for final securing and welding of next-to-last and final rope wraps of film-tail 14, gripper-cutter assembly 42 is brought in position to grasp film-tail 14 of the final rope wrap to secure it in position prior to final weldment and severing. The alternate positions of cutter-gripper 42 are illustrated in FIGS. 9, 18, 22 and 23. In FIG. 6, lever arm first or pivot end 252 has a cross-port 256 for pivot pin 258 to mate with mounting bracket 260 extending from mounting plate or platform 60. Pneumatic operator 262 is pivotally secured at its back end 264 to mounting bracket 266 anchored to platform lower surface 61 of mounting platform 60, with operator 262 extending through port 268 in platform 60 for pivotal coupling to lever arm 250 at pivot pin 270, which pin is generally centrally located along arm 250 between first and second ends 252, 254. Pneumatic operator 262 moves lever arm 250 between an extended and grasping position in FIG. 18 and the retracted and reference position shown in FIG. 9. A pair of generally vertically extending fingers 290, 292 are separated by gap 294 and secured to lever arm 250 at its upper surface 272 in proximity to second end 254. A pivot arm 274 with a cam roller 279 is secured to lever arm 250 at pivot means 278 for rotation thereon. Pivot arm 274 has pivot tongue 280 projecting above upper surface 272 and in proximity to fingers 290, 292, which pivoting arm 274 grasps the final rope wrap between the projecting tongue 280 and L-shaped fingers 290, 292 to secure film-tail 24 for subsequent wrapping operations. Cam 286 with cam surface 288 is secured to a retention bracket 289 anchored to platform 60, and cam roller 279 is movable along cam surface 288 during rotation of lever arm 250 about pivot pin 256, which induces rotation of arm 274 about pivot pin 278 to grip film-tail 14. Biasing spring 291 is secured between lever arm 250 and the pivoting arm 274 to bias pivot arm 274 to its reference position at the reference position of the gripper-cutter assembly 42 in FIG. 9. Extension of piston 300 and connecting rod 302 of pneumatic operator 262 rotates lever arm 250 about pivot operator 256, which induces pivoting of lever arm 274 about pivot means 278 by the movement of cam roller 279 along cam surface 288 to rotate flexible arm 274 and provide finger 280 in proximity to L-shaped fingers of upper surface 272 to grasp the final rope wrap. After completion of the securing operation and film weldment between pressure bar 52 and anvil 48, cutter 298 severs the final rope wrap between the weldment and the gripper fingers, thus allowing the secured stretch film to recover to or about wrapped package 26 and to retain film-tail 14 in gripper assembly 42 for initiation of the next wrapping cycle. In the Figures cutter 198 has a blade 297, which may be a hot-knife for severing the film wrap.

As noted above, the several pneumatic operators are controlled and operable through manifold assembly 56. In FIG. 6, assembly 56 has a distribution manifold 300 with an input end 302, an exhaust port 304, a distribution network therein (not shown), and a plurality of solenoid operated valves coupling the input and exit networks to the several pneumatic operators. Inlet port 302 is coupled to a source of fluid at a pressure 306 by conduit 308 to provide fluid at a pressure to manifold 300 and the several pneumatic operators. Pneumatic operators 90 of each of rope guide assemblies 44 and 46 are coupled to first solenoid operator 320 by input conduit 322 and exhaust conduit 324. Pneumatic operators 90 are coupled in parallel to input and exhaust conduits 322, 324 to provide synchronous action to the guides 44, 46 for moving them between the film engaging and disengaging positions. Solenoid valve operator 320 and each of the illustrated several solenoid valve operators are operable to provide coupling between the manifold input network and the exhaust port 304 of manifold 300.

Pneumatic operator 126 of anvil 48, which may be similar to pneumatic operators 90, is coupled to second solenoid operator 326 by inlet conduit 328 and exhaust conduit 330 for reciprocating action of piston 132. It is readily apparent that pneumatic operators 222, 198, 262 and 196 are coupled to the sequentially arranged solenoid-operated valves 332, 334, 336, and 338 by respective inlet and exhaust conduits 340, 342, 344, 346, 348, 350, 352 and 354, respectively. Further, the mechanical actuation and operation of these pneumatic operators is known in the art.

Solenoid operators 320–328, which are operable to open or seal fluid communication to the several pneumatic operators, are responsive to control signals from control system 58. System 58 may incorporate a central processing unit (CPU) operable to receive signals from remote sensing apparatus 380, such as a magnetic or star-wheel position sensor, which senses a position of boom arm 20 and communicates this relative position to control system 58 through conduit line 382. System 58 receives the sensed signal and is operable to provide an output signal to the several solenoid operators through lines 384, 386, 388, 390, 392 and 394, respectively, for control of the fluid flow to the several pneumatic operators and thus control movement of rope guides 44, 46, anvil 48, pressure bar 52, heater 54 and gripper-cutter 42 between their reference and operating positions. Further, control system 58 is coupled to cutter 298 by conducting line 400 to conduct electrical power to cutter 298 and hot-knife 297 to sever the grasped film-tail 14 at the termination of the welding and securing operations. System 58 may also be coupled to heater 54 by conductor line 402 to continuously heat element 220 and maintain it at a predetermined temperature. Sensors 404, in FIG. 19, which may be mounted and operable on frame 22 or conveyor 28, are coupled to control system 58 through conducting lines 406 to provide locating signals to the CPU for generation of control signals for boom 20 and heat assembly 10 in response thereto. These sensors may be photoelectric operators as known in the art, and may be appropriately located for sensing the position of package 26.

In operation, heat assembly 10 is initially provided with a film-tail 14 secured in gripper-cutter assembly 42 for initiation of a wrapping cycle about package 26 positioned in frame 22, which package position is sensed by sensors 404 for signalling to control system 58 through conductor 406. Thereafter control system 58 actuates the sequence of operations of the boom arm 20, film-stretch mechanism 18 and heat-seal assembly 10, either in response to sensed signals from sensor 380 or as a timed function. This control is provided by signals communicated to the several solenoid operators or heater components to control their operation and function within heat-seal assembly 10. In a particular embodiment, the film-tail 14 is retained in gripper-cutter 42 for at least several wraps of the film 24 about package 26 to ensure retention of the film wrap about this package. As boom 20 rotates about package 26, stretching mechanism 18 is reciprocating on elevator arm 38 to provide a spiral configuration of film 24 about package 26. At the end of the wrapping cycle the roping mechanism, which is generally integral with stretching mechanism 18, provides a roped or agglomerated film strip to complete the wrapping cycle. The roped film is brought into proximity of heat-seal assembly 10 and rope guides 44, 46 by the arc travel of boom 20 and stretching mechanism 18.

Initiation of the heat sealing operation and thus the operation of heat-seal assembly 10, may be through a signal from position sensor 380, which notes and signals the position of boom arm 20 for control system 58. Responsive to the sensed signals, solenoid valve 320 may be actuated for communication of fluid at a pressure to pneumatic operators 90 and movement of arms 70 of rope guides 44, 46 to their film-engaging positions from the reference position. The rotational path of boom arm 20 provides the film in position for grasping by guides 44, 46. More particularly, the next-to-last wrap of roped film 24 is tautly grasped between guides 44, 46 and anvil 48 is elevated to its upright or operating position by actuation of solenoid operator 326 and pneumatic operator 126 in response to a signal from control system 58. Rotation of anvil 48 to its operating position interposes anvil 48 between the retained next-to-last wrap of roped film and package 26 with the film in proximity to anvil face 50. Thereafter, rope guides 44, 46 are withdrawn to the reference position and the taut or tensed rope wrap contacts anvil face 50 and is retained there by the tensile forces of the stretched film 24 acting to recover about package 26, which film 24 extends from package 26 through the notches 156, 158 and against anvil face 50. Posts 160, 162 normally extending from anvil face 50 provide vertical support to the film wrap to maintain it against face 50.

The final wrap of roped film about package 26 is brought into position between guide arms 70 of first and second rope guides 44, 46, which arms are again elevated to the engaging position. This final film wrap is thus provided in alignment with but separated from the next-to-last wrap of roped film at anvil face 50 by a narrow gap or distance. Travel of boom arm 20 is then ceased at a position downstream of heat-seal assembly 10 at any location desired, such as at a corner of package 26. Although boom arm 20 is illustrated at a corner of package 26 for the end of the wrapping cycle, it is understood that the boom-arm position only requires that the film extend past second rope guide 46. Subsequently, heater bar 54 is elevated to move heat element 220 into the narrow gap between the aligned wraps of film to heat the opposed surfaces of each of the final and next-to-last film wraps. After positioning of the final film wrap and heater element 220, pressure bar 52 is rotated into the operating position to provide pressure head 180 in alignment with anvil face 50 for compression of the film wraps against anvil face 50 and the heated film surfaces against each other for attainment of the weldment. Prior to the compression stroke, pressure bar 52 presses the roped film wraps against heater element 220 to insure intimate contact of the roped-film wrap surfaces against the heated surface for a predetermined time and thus surfaces adequate for weldment. Thereafter the compressive pressure from bar 52 is relieved for rapid removal of heater element 220 to its reference position and rapid compression of the heated film surfaces against each other for weldment. After rotation of pressure bar 52 to the operating position and completion of the weldment, gripper-cutter 42 is moved to the gripping position to grasp the final rope wrap between the sealing position and the stretching mechanism 18. Film-tail 14 after completion of the seal and weldment is severed by energization of cutter 298, and film-tail 14 is retained in the gripper for the next wrapping cycle. All of the several heat assembly components return to their reference position after gripper-cutter 42 grasps film-tail 14 and completion of the weldment. It is noted that the sequence of operation of each of the multiple components of heat seal assembly 10 is accommodated by control system 58, which provides actuating signals to the several solenoid operators in response to time or externally sensed parameter signals, such as from sensor 380.

Although the above preferred embodiment specifically describes a packaging assembly with a rotating boom arm 20, it is recognized that heat seal assembly 10 is operable with a packaging machine having a fixed boom arm 20. In such an apparatus, package 26 may be provided on a rotating table, while film-stretching mechanism 18 is reciprocal on elevator 38. Heat sealer 10 may be mounted on the package turntable for the grasping and sealing operations. In addition, the above-described preferred embodiment utilized a web of stretch film, however, the description is generally applicable to plastic netting materials. The specific packaging assembly and equipment for netting materials may not require a stretching mechanism 18, but heat seal assembly 10 is similarly operable with either of these plastic wrapping materials and packaging systems. Disclosure and description of the preferred embodiment is not intended to limit application of the heat seal assembly to a particular package assembly structure.

While only specific embodiments of the invention have been described and shown, it is apparent that various alterations and modifications can be made therein. It is, therefore, the intention in the appended claims to cover all such modifications and alterations as may fall within the scope and spirit of the invention.

What is claimed is:

1. A heat seal assembly for securing aligned first and second wraps of stretch film with a sealing gap therebetween at a sealing position, said assembly comprising:

a mounting platform;

a first rope guide, a second rope guide, which first and second rope guides are mounted on said platform and pivotable between a disengaged position and an engaged position;

first means for moving said first rope guide and second rope guide between said disengaged and engaged positions;

a sealer anvil mounted on said platform and movable between an inactive position and an actuated position to retain said first wrap at the sealing position;

second means for moving said anvil between said inactive and actuated positions;

a sealer pressure bar for compressing said aligned first and second film wraps to said anvil, third means for moving said pressure bar between a withdrawn position and a film-engaging position; and a film-heater bar for heating said stretch film, fourth means for moving said film-heater bar into said gap between said first and second wraps from a disengaged reference position, said third means for moving operable to move said pressure bar to compress said first and second wraps against said heater bar to melt a portion of said first and second wraps and thereafter allow said heater bar to withdraw to said reference position and immediately compress said first and second film wraps at said melted portions against said anvil for sealing said film first and second wraps.

2. A heat seal assembly as claimed in claim 1 further comprising a film gripper-cutter, operable to grip and cut a film wrap; and, fifth means for moving said gripper-cutter grasp said second film wrap after sealing, to sever said second film wrap and to retain said second wrap in position for initiation of a subsequent operation.

3. A heat seal assembly as claimed in claim 2 wherein said first, second, third, fourth and fifth means for moving include a plurality of pneumatically operable piston and cylinder assemblies, at least one of said piston and cylinder assemblies operably connected to each of said first and second rope guides, said anvil, said pressure bar, said heater and said gripper-cutter.

4. A heat-seal assembly as claimed in claim 3 further comprising a manifold with an input duct, a discharge duct, a fluid distribution network and, a plurality of inlet ports and outlet ports;

a source of fluid at a pressure, means for coupling connected between said input duct and source of fluid to communicate said fluid to said manifold;

a plurality of solenoid-operated valves, said manifold having at least one solenoid-operated valve for each pair of inlet and outlet ports;

second means for coupling each said piston and cylinder assembly to a solenoid-operated valve on said manifold;

means for controlling, coupled to a source of electrical energy;

a plurality of lines, at least one line coupled between each said manifold solenoid valve and said control means for actuation of said each said valve, to open and close fluid flow to said coupled cylinder assembly through said inlet and outlet ports, respectively.

5. A heat seal assembly as claimed in claim 2 wherein said first, second, third, fourth and fifth means for moving are electrically driven operators.

6. A heat seal assembly as claimed in claim 4 wherein said gripper-cuter has a cutter, which cutter is an electrically operable cutting blade on an insulated block, at least one of said lines coupled between said blade and said means for controlling, said blade electrically energizable through said control means to cut said grasped second film wrap.

7. A heat seal assembly as claimed in claim 6 wherein said heater bar is operably coupled to said source of electrical energy by at least one of said plurality of lines for heating of said heater bar and said film wrap.

8. A heat seal assembly as claimed in claim 7, further comprising at least one sensor connected to said controlling means, said means for controlling operable to receive a sensed signal and to provide a control signal to said electrical energy source to energize and deenergize each of said manifold solenoid valves, film-heater bar and cutter blade.

9. A heat seal assembly as claimed in claim 8 wherein said first and second rope guides are actuated by said controlling means to move to said engaged position to grasp and position said first wrap for said anvil, to return to said disengaged position for subsequent return to said engaged position, and grasping and positioning of said second wrap for said pressure bar and film heater.

10. A heat seal assembly as claimed in claim 9 wherein said first and second wraps are aligned between said anvil and pressure bar with said sealing gap therebetween, said controlling means operable to actuate said solenoid valves to move said heater bar into said gap, and to move said pressure bar to compress said first and second wraps against said heater bar for melting the wrap surfaces for heat sealing.

11. A heat seal assembly as claimed in claim 1 wherein said heater bar is continuously maintained at a predetermined temperature.

12. A heat seal assembly as claimed in claim 1 wherein said first and second wraps are maintained against said heater bar for a predetermined time to provide a heating cycle.

13. A heat seal assembly as claimed in claim 1 wherein said stretch film is a netting mesh of plastic material.

14. In a stretch film wrapping apparatus for wrapping a load with at least a first and a second wrap of stretch film, said apparatus having a load-carrying table, a framework, a rotatable boom arm extending from said framework, a film stretching mechanism to stretch a plastic film mounted and reciprocal on said boom arm, means for controlling coupled to a source of electrical energy, means for sensing the position of said boom arm, which sensing means is coupled to and provides a boom-arm position signal to said controlling means, and a heat-seal assembly for sealing said stretch film after completion of said load wrapping, which heat-seal assembly is coupled to said controlling means for actuation in response to a positional signal, said assembly comprising:

a mounting platform;

a first rope guide and a second rope guide pivotably mounted no said platform for movement between a film engaged and a film disengaged position, said guides at said engaged position operable to grasp a wrap of said film;

a sealer anvil mounted on said platform and movable between an inactive position and an actuated position at the grasping of a first wrap of said film by said guides;

a sealer pressure bar pivotable from a stored position to a withdrawn position juxtaposed to said anvil and transverse to said grasped wrap, which pressure bar is movable to a film-contacting position for applying a pressure to said film;

a film-heater bar for heating said stretch film, said apparatus operable to provide a first wrap and a second wrap of film between said anvil and pressure bar with a gap therebetween, each of said first and second film wraps having a gap-facing surface, said film-heater bar is coupled to said source of electrical energy through said controlling means, heated to a predetermined temperature and positioned in said gap to heat said film for a predetermined time, which heater bar is removed to a disengaged reference position for compression of said first and second film wraps between said anvil and said pressure bar at said heated, gap-facing surfaces to seal said first and second wraps.

15. A heat-seal assembly as claimed in claim 14, said film-stretching mechanism having means for roping said film, said first wrap and second wrap in said gap are constrained by said roping means to a rope-like shape, said anvil having an anvil face in proximity to said gap, which face has a first longitudinal edge and a second longitudinal edge, a first tapered notch at said first edge and a second tapered notch at said second edge, which first wrap includes extending portions from said load to said anvil face edges, said notches provide said first wrap directed extensions from said load to said anvil at either edge of said anvil face to avoid interference with said film second wrap and stretching mechanism.

16. In a stretch film wrapping apparatus for wrapping a load with at least a first and a second wrap of stretch film, said apparatus having a rotatable, load-carrying table, a film stretching mechanism to stretch a plastic film mounted and reciprocal on an elevator arm, means for controlling coupled to a source of electrical energy, means for sensing the position of said load-carrying table, which sensing means is coupled to and provides a table position signal to said controlling means, and a heat-seal assembly for sealing said stretch film after completion of said load wrapping, which heat-seal assembly is coupled to said controlling means for actuation in response to a positional signal, said assembly comprising:

a mounting platform;

a first rope guide and a second rope guide pivotably mounted on said platform for movement between a film engaged and a film disengaged position, said guides at said engaged position operable to grasp a wrap of said film;

a sealer anvil mounted on said platform and movable between an inactive position and an actuated position at the grasping of a first wrap of said film by said guides;

a sealer pressure bar pivotable from a stored position to a withdrawn position juxtaposed to said anvil and transverse to said grasped wrap, which pressure bar is movable to a film-contacting position for applying a pressure to said film;

a film-heater bar for heating said stretch film, said film-wrapping apparatus operable to provide a first wrap and a second wrap of film between said anvil and pressure bar with a gap therebetween, each of said first and second film wraps having a gap-facing surface, said film-heater bar is coupled to said source of electrical energy through said controlling means, heated to a predetermined temperature and positioned in said gap to heat said film for a predetermined time, which heater bar is removed to a disengaged reference position for compression of said first and second film wraps between said anvil and said pressure bar at said heated, gap-facing surfaces to seal said first and second wraps.

17. A heat sealing assembly for securing aligned first wrap and second wrap of plastic film extending around a package assembly comprising:

a first rope guide, a second rope guide, which guides are operable to retain a film wrap displaced from and extending around said package;

an anvil operable as a compression surface;

a heater bar for applying heat to elevate the temperature of first and second wrap surfaces contacting said heater bar; and, a pressure bar to compress said first and second wrap against said heater bar and against said anvil at said heated wrap surfaces to effect weldment between said first and second wraps at the heated wrap surfaces.

18. In a wrapping apparatus having a stretching mechanism and a source of stretch film, a method of sealing the stretch film to itself to secure a film wrap about a package utilizing a heat-sealing assembly for securing said film to itself with the next-to-last wrap and final wrap around said package, which method comprises:

a. wrapping a package with said film by relative rotation of said stretching mechanism and package;

b. grasping said next-to-last wrap with a first guide and a second guide to provide an elongate film strip between said first and second guides;

c. moving an anvil with an anvil face between said package and said film strip;

d. returning said first and second guides to their disengaged position, allowing the leading and trailing edge of said next-to-last wrap to directly and angularly extend from said package to said anvil to avoid intereference with said final wrap;

e. continuing said wrapping to provide said final wrap about said package;

f. moving said first and second guides to the engaged position to grasp said final wrap to provide a second elongate film strip juxtaposed to said next-to-last wrap at said anvil face, said next-to-last and final wraps cooperating to define a gap therebetween;

g. moving a pressure bar anterior said gap and final wrap and aligned with said anvil;

h. sliding a heater bar into said gap to contact said first and second wraps and elevate their film temperatures at said gap to a predetermined temperature; and, i. removing said heater bar from said gap and immediately clamping said pressure bar against said anvil to compress said next-to-last film wrap and final film wrap at said elevated temperatures to weld said film wraps together and secure said film about said package.

19. A method for securing a film wrap about a package as claimed in claim 18 further comprising pressing said next-to-last and final film wraps against said heater bar to maintain contact therewith.

20. A method for securing a film wrap about a package as claimed in claim 18 further comprising gripping said final wrap downstream of said anvil and pressure-bar gap with a cutter-gripper; cutting said final wrap after said welding to provide a film-tail; and, retaining said final wrap film-tail in said cutter-gripper for a subsequent wrapping cycle.

* * * * *